US009573136B2

(12) United States Patent
Noge

(10) Patent No.: US 9,573,136 B2
(45) Date of Patent: Feb. 21, 2017

(54) TONER PRODUCING APPARATUS AND TONER PRODUCING METHOD

(71) Applicant: Koji Noge, Shizuoka (JP)

(72) Inventor: Koji Noge, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 637 days.

(21) Appl. No.: 14/018,922

(22) Filed: Sep. 5, 2013

(65) Prior Publication Data

US 2014/0070035 A1 Mar. 13, 2014

(30) Foreign Application Priority Data

Sep. 7, 2012 (JP) ..... 2012-197461

(51) Int. Cl.

| | |
|---|---|
| ***B02C 23/00*** | (2006.01) |
| ***B02C 23/08*** | (2006.01) |
| ***B07B 7/01*** | (2006.01) |
| ***B02C 13/00*** | (2006.01) |
| ***G03G 9/08*** | (2006.01) |
| ***G03G 9/087*** | (2006.01) |
| ***G03G 9/09*** | (2006.01) |

(Continued)

(52) U.S. Cl.

CPC ..... *B02C 23/08* (2013.01); *B02C 13/00* (2013.01); *B07B 7/01* (2013.01); *G03G 9/081* (2013.01); *G03G 9/0815* (2013.01); *G03G 9/0817* (2013.01); *G03G 9/0819* (2013.01); *G03G 9/08711* (2013.01); *G03G 9/0904* (2013.01); *G03G 9/09783* (2013.01); *B07B 7/04* (2013.01)

(58) Field of Classification Search

CPC ..... B02C 23/08; G03G 9/0817; B07B 7/01; B07B 7/04

USPC ..... 241/81, 101.2; 209/146, 497, 3

See application file for complete search history.

(56) References Cited

U.S. PATENT DOCUMENTS 1,875,531 A 9/1932 Walton
4,245,999 A * 1/1981 Reiniger ..... B02C 13/14 209/17

(Continued)

FOREIGN PATENT DOCUMENTS

JP 6-55022 3/1994
JP 08-15906 A 1/1996

(Continued)

OTHER PUBLICATIONS

Extended European Search Report issued Jul. 7, 2014 in Patent Application No. 13183099.4.

*Primary Examiner* — Faye Francis

(74) *Attorney, Agent, or Firm* — Oblon, McClelland, Maier & Neustadt, L.L.P.

(57) ABSTRACT

A toner producing apparatus including: a foreign matter separating unit including a foreign matter separating chamber for separating metallic foreign matters contained in raw powder material of toner from the raw powder material of toner by using gravity, a feeding pipe connected to the foreign matter separating chamber so as to feed the raw powder material of toner into the foreign matter separating chamber, and an exhausting pipe connected to the foreign matter separating chamber so as to exhaust the raw powder material of toner from the foreign matter separating chamber; and a pulverizing unit including a rotor, the pulverizing unit being connected to the exhausting pipe of the foreign matter separating unit.

19 Claims, 11 Drawing Sheets

(51) Int. Cl.
*G03G 9/097* (2006.01)
*B07B 7/04* (2006.01)

(56) References Cited

U.S. PATENT DOCUMENTS

| | | | | |
|---|---|---|---|---|
| 4,782,001 | A * | 11/1988 | Kanda | G03G 9/0817 209/10 |
| 5,174,455 | A | 12/1992 | Zelazny et al. | |
| 7,162,785 | B2 * | 1/2007 | Koumura | B03B 9/061 241/24.1 |
| 2008/0227022 | A1 | 9/2008 | Noge et al. | |
| 2009/0135016 | A1 | 5/2009 | Yamaguchi et al. | |
| 2009/0233213 | A1 | 9/2009 | Noge | |
| 2012/0104123 | A1 | 5/2012 | White et al. | |
| 2012/0305688 | A1 * | 12/2012 | Bai | C10L 5/06 241/68 |

FOREIGN PATENT DOCUMENTS

| | | | |
|---|---|---|---|
| JP | 9-187732 | A | 7/1997 |
| JP | 09-276634 | | 10/1997 |
| JP | 10-249120 | | 9/1998 |
| JP | 11-319601 | | 11/1999 |
| JP | 2005-95827 | | 4/2005 |
| JP | 2005-144444 | | 6/2005 |
| JP | 2006-505419 | A | 2/2006 |
| JP | 2007-091890 | A | 4/2007 |
| JP | 2007-169534 | A | 7/2007 |
| JP | 2008-200952 | A | 9/2008 |
| JP | 2009-131965 | | 6/2009 |
| JP | 2009-223066 | | 10/2009 |
| JP | 2010-51875 | | 3/2010 |
| JP | 2011-104582 | | 6/2011 |
| WO | WO 2008/032547 | A1 | 3/2008 |
| WO | WO 2009/158709 | A2 | 12/2009 |

* cited by examiner

TONER PRODUCING APPARATUS AND TONER PRODUCING METHOD

BACKGROUND OF THE INVENTION

Field of the Invention

The present invention relates to a toner producing apparatus, and a toner producing method.

Description of the Related Art

In a method of producing fine powder with mills, impact plate type mills, counter jet mills, and mechanical mills may be included as examples of mills that can produce fine powder having an average pulverized particle diameter of 4 μm to 10 μm at a production output of 150 kg/h to 200 kg/h if raw powder material having a particle diameter of approximately 30 μm is fed into the mills.

The impact plate type mills have such a feature that accelerates raw powder material by jet streams, and forces the accelerated raw powder material to collide against an impact plate so as to pulverize the raw powder material. The IDS series of Nippon Pneumatic Mfg. Co., Ltd. may be included as an example of the impact plate type mills, for example.

The counter jet mills have such a feature that accelerates raw powder material with counter jet streams, and allows the accelerated raw powder material to collide against each other. PJM-I of Nippon Pneumatic Mfg. Co., Ltd., Micron Jet Mill and Counter Jet Mill of Hosokawa Micron Corporation, and Cross Jet Mill of Kurimoto Ltd. may be included as examples of the counter jet mills, for example.

The impact plate type mills and the counter jet mills have such a configuration that injects raw powder material along with ultra-high speed jet streams, and allows the raw powder material to collide against the impact plate, or collide against each other, thereby pulverizing the raw powder material.

The impact plate type mills and the counter jet mills require great amount of air in order to accelerate the raw powder material using jet streams. Consequently, they have problems such as great electricity consumption, high energy cost, and great impact on environment.

Meanwhile, in the light of reduction in energy cost and impact on environment, the mechanical mills have been used as mills more efficient than the impact plate type mills and the counter jet mills. The mechanical mills feed raw powder material into gaps between rotors rotating at a high speed and stators so as to pulverize the raw powder material. Hence, the mechanical mills require no jet streams, and consume almost no compressed air during pulverizing the raw powder material. Accordingly, the mechanical mills can produce fine powder with saved energy.

As an example of the mechanical mills, there has been suggested a mechanical mill that includes a pulverizing chamber including a rotor and a stator disposed with a predetermined gap therebetween, and pulverizes raw powder material fed in the pulverizing chamber into fine powder through collision among the rotor, the stator, and the raw powder material accompanied by the rotation of the rotor (see Japanese Patent Application Laid-Open (JP-A) No. 2010-51875, for example).

Not only such mechanical mills, but also any mills using rotors can produce fine powder with reduced energy.

Raw powder material to be fed in a mill using a rotor is produced such that resin, colorant, and others are kneaded, for example, and furthermore raw powder material may be roughly pulverized if necessary. The above kneading process is carried out by a kneading machine. For example, in producing raw powder material for electrophotographic toner, a kneading machine having a crew is generally used. Such a kneading machines having a screw includes the screw and a casing disposed at the outer periphery of the screw. The screw has helical projections around its shaft. The screw or the casing is provided with pins that are column-like projections. Such a kneading machine having the screw efficiently carries out kneading operation in cooperation with the projections of the screw, and the pins.

During producing raw powder material through a kneading machine having a screw, metallic foreign matters may be mixed in the raw powder material resulted from the screw and the pins. High pressure is generated inside the kneading machine during the kneading operation. Such high pressure is likely generated between the helical projections of the screws, between the pins, and between the helical projections and the pins, etc. Hence, the helical projections or the pins become broken due to fatigue, impact, or the like because of such high pressure, resulting in generation of the metallic foreign matters. It has also been known that, for example, fatigue fracture is caused to a screw in a kneading machine (see JP-A No. 2009-131965, for example). Broken pieces of the screw resulted from the fatigue fracture become the above metallic foreign matters.

Contamination of metallic foreign matters in raw material powder causes the following problems. One is that if the metallic foreign matters along with the raw powder material are fed in a mill, the metallic foreign matters collide against a rotor of the mill, which may case breakage of the rotor. The metallic foreign matters held in a gap between the rotor and stator may cause such a problem that the metallic foreign matters stop the mill. Another is that the metallic foreign matters mixed in the raw powder material are pulverized by the mill, resulting in contamination of fine pieces of the pulverized metallic foreign matters in finished toner. In this case, such a problem may be caused that the finished toner containing the fine pieces of the metallic foreign matters causes damage on a photoreceptor in an image forming process.

A method of providing a filter for removing the metallic foreign matters in conveyance piping may be included as an example of conventional methods of removing the metallic foreign matters, for example. Unfortunately, mills that produce fine powder have so small gaps inside the mills that the raw powder material is needed to be supplied at high static pressure. Particularly in the mills using rotors, the raw powder material passes through extremely fine gaps, so that it is difficult to supply the raw powder material at low static pressure, and thus high static pressure is inevitably required in conveyance piping for supplying the raw powder material. Consequently, no filter can be installed in the conveyance piping for supplying the raw powder material into the mills.

Accordingly, it has been desired to provide a toner producing apparatus capable of separating metallic foreign matters from raw powder material of toner before the raw powder material of toner is pulverized by a mill using a rotor, capable of preventing the mill using a rotor from being damaged and stopped, and also capable of preventing produced toner from causing damage on a photoreceptor.

SUMMARY OF THE INVENTION

An object of the present invention, which has been made in order to solve the various problems according to the conventional art, is to provide a toner producing apparatus capable of separating metallic foreign matters from raw powder material of toner before the raw powder material of toner is pulverized by a mill using a rotor, capable of preventing the mill using the rotor from being damaged and stopped, and also capable of preventing produced toner from causing damage on a photoreceptor.

A solution to solve the above problems is as follows. Specifically, a toner producing apparatus of the present invention includes:

a foreign matter separating unit including a foreign matter separating chamber for separating metallic foreign matters contained in raw powder material of toner from the raw powder material of toner by using gravity, a feeding pipe connected to the foreign matter separating chamber so as to feed the raw powder material of toner into the foreign matter separating chamber, and an exhausting pipe connected to the foreign matter separating chamber so as to exhaust the raw powder material of toner from the foreign matter separating chamber; and a pulverizing unit including a rotor, the pulverizing unit being connected to the exhausting pipe of the foreign matter separating unit.

According to the present invention, it is possible to provide a toner producing apparatus capable of solving various conventional problems, and capable of separating metallic foreign matters from raw powder material of toner before the raw powder material of toner is pulverized by a mill using a rotor, capable of preventing the mill using the rotor from being damaged and stopped, and also capable of preventing produced toner from causing damage on a photoreceptor.

Figure 1:
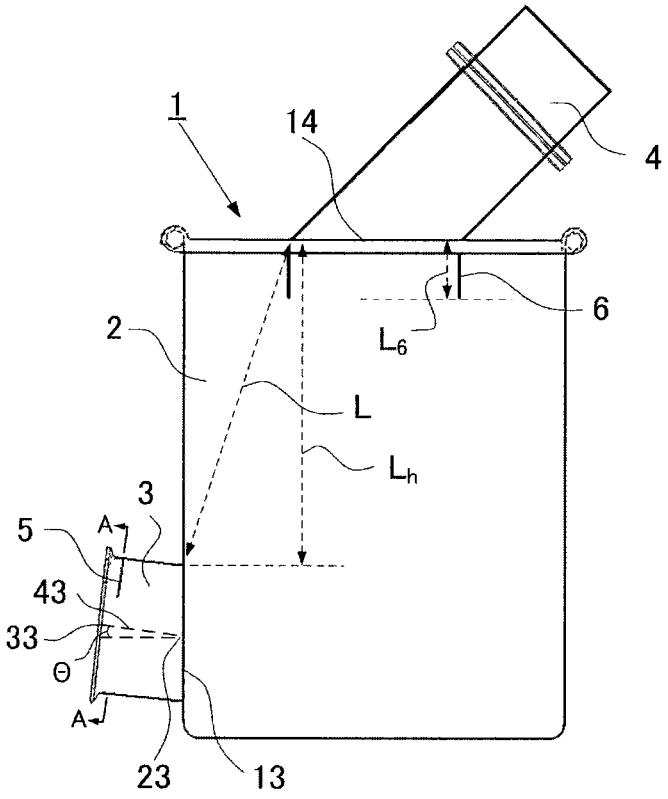
FIG. 1 is a schematic cross sectional view showing an example of a foreign matter separating unit.

DETAILED DESCRIPTION OF THE INVENTION (Toner Producing Apparatus, and Toner Producing Method)

The Toner Producing Apparatus of the Present Invention Includes at least a foreign matter separating unit, and a pulverizing unit, and also other components if necessary.

The toner producing method of the present invention includes at least a foreign matter separating step, and a pulverizing step, and also other steps if necessary.

<Foreign Matter Separating Unit, and Foreign Matter Separating Step>

The foreign matter separating unit includes at least a foreign matter separating chamber, a feeding pipe, and an exhausting pipe, and also other members if necessary.

The foreign matter separating step is not limited to a specific one, and any foreign matter separating procedure may appropriately be selected in accordance with the purpose as far as this step can separate the metallic foreign matters contained in the raw powder material of toner from the raw powder material of toner using gravity in the foreign matter separating chamber of the foreign matter separating unit.

The metallic foreign matters are sometimes mixed in the raw powder material of toner in a process of producing the raw powder material of toner.

The raw powder material of toner is produced in such a manner that binder resin, colorant, and others are kneaded, for example, and furthermore the raw powder material of toner is roughly pulverized if necessary. This kneading process is carried out by a kneading machine. A kneading machine having a screw (see FIG. 4 of JP-A No. 11-77667, for example) may be used as the above kneading machine, for example. Such a kneading machine having a screw includes the screw, and a casing disposed at an outer periphery of the screw. The screw has helical projections around its shaft. The screw or the casing is provided with pins that are column-like projections. Such a kneading machine having the screws carries out kneading operation in cooperation with the projections of the screw and the pins. High pressure is generated inside the kneading machine during the kneading operation. The high pressure is likely generated between the helical projections of the screw, between the pins, or between the helical projections and the pins, etc. Hence, the helical projections or the pins become broken due to fatigue, impact, and the like because of such high pressure, resulting in generation of the metallic foreign matters. Fatigue fracture is caused to the screws in the kneading machine. Broken pieces of the screw resulted from the fatigue fracture become the aforementioned metallic foreign matters.

Even if the metallic foreign matters are mixed in the raw powder material of toner in the above manner, in the toner producing apparatus and the toner producing method of the present invention, the foreign matter separating unit and the foreign matter separating step separate the metallic foreign matters from the raw powder material of toner. This configuration can prevent the metallic foreign matters from intruding into a pulverizing unit including a rotor, and from being mixed in produced toner.

Examples of materials of the metallic foreign matters may be stainless steel, steel, duralumin (aluminum alloy), and titanium alloy, etc., for example.

The size of the metallic foreign matters may be 1 mm to 10 mm, for example. If the metallic foreign matters have irregular shapes, the size of each metallic foreign matter is defined by using a diameter of a sphere including this metallic foreign matter.

<<Foreign Matter Separating Chamber, Feeding Pipe, and Exhausting Pipe>>

The foreign matter separating chamber is not limited to a specific one, and any foreign matter separating chamber may appropriately be selected in accordance with the purpose as far as this foreign matter separating chamber can separate the metallic foreign matters contained in the raw powder material of toner from the raw powder material of toner using gravity.

The feeding pipe is not limited to a specific one, and any feeding pipe may appropriately be selected in accordance with the purpose as far as this feeding pipe is connected to the foreign matter separating chamber so as to feed the raw powder material of toner into the foreign matter separating chamber.

The exhausting pipe is not limited to a specific one, and any exhausting pipe may appropriately be selected in accordance with the purpose as far as this exhausting pipe is connected to the foreign matter separating chamber so as to exhaust the raw powder material of toner from the foreign matter separating chamber.

Connection among the foreign matter separating chamber, the feeding pipe, and the exhausting pipe may be accomplished by joining their connected portions, or in an indefinite manner that allows their connected portions to be seamless. In the case of using the indefinite connection, the foreign matter separating chamber, the feeding pipe, and the exhausting pipe may be formed by changing an inner diameter of a single pipe, or the like, for example.

In the foreign matter separating chamber, the connected portion between the exhausting pipe and the foreign matter separating chamber is preferably disposed at a gravitationally higher position than the connected portion between the feeding pipe and the foreign matter separating chamber. This configuration more effectively utilizes gravity to separate the metallic foreign matters from the raw powder material of toner.

It is preferable that a center of one end of the feeding pipe located at the connected portion between the feeding pipe and the foreign matter separating chamber is disposed at a gravitationally lower position than a center of the other end opposite to this one end of the feeding pipe. This configuration prevents occurrence of cyclones in the foreign matter separating chamber, and also prevents the metallic foreign matters from being exhausted from the exhausting pipe before the metallic foreign matters are separated from the raw powder material of toner.

An angle range of more than 0°, and 50° or less is preferable, and an angle range of 3° to 30° is more preferable for an angle formed between a perpendicular direction to the gravitational direction and a pipe center line that connects a center of the one end of the feeding pipe located at the connected portion between the feeding pipe and the foreign matter separating chamber, and a center of the other end opposite to this one end of the feeding pipe. This configuration can further suppress occurrence of cyclones.

The feeding pipe preferably includes a blocking portion disposed on an inner peripheral surface of the feeding pipe on the opposite side to the gravitational direction in such a manner that the blocking portion partially reduces an area of a cross section of the feeding pipe in the perpendicular direction to a conveyance direction of the raw powder material of toner. This configuration can reduce accumulation of the raw powder material of toner in the foreign matter separating chamber, which becomes a loss. It is preferable to dispose the blocking portion in the feeding pipe in the light of suppressing occurrence of cyclones in the foreign matter separating chamber.

The shape of the blocking portion is not limited to a specific one, and any shape thereof may appropriately be selected as far as this shape partially reduces the area of the cross section of the feeding pipe in the perpendicular direction to the conveyance direction of the raw powder material of toner.

The blocking portion preferably has such a structure that sequentially blocks the inner surface of the feeding pipe toward the gravitational direction from the opposite direction to the gravitational direction of the inner surface of the feeding pipe.

The blocking portion preferably reduces the area of the cross section of the feeding pipe in the perpendicular direction to the conveyance direction of the raw powder material of toner by more than 0%, and 60% or less, and more preferably by 20% to 30%. In other words, it is preferable to define the area of the blocking portion in the cross section perpendicular to the conveyance direction of the raw powder material of toner in the feeding pipe to be more than 0% and 60% or less, and more preferably from 20% to 30% relative to the area of the cross section of the feeding pipe in the perpendicular direction to the conveyance direction of the raw powder material of toner. This configuration can further reduce the amount of the raw powder material of toner that precipitates in the foreign matter separating chamber. It is also possible to prevent occurrence of cyclones in the foreign matter separating chamber more effectively.

The exhausting pipe is preferably connected to a surface of the foreign matter separating chamber on the opposite side to the gravitational direction. This configuration can effectively separate the metallic foreign matters from the raw powder material of toner.

The foreign matter separating chamber preferably has projections projecting inward of the foreign matter separating chamber at the connected portion between the exhausting pipe and the foreign matter separating chamber. This configuration can prevent the metallic foreign matters from intruding into the exhausting pipe even if cyclones occur in the foreign matter separating chamber.

The length of the projection is not limited to a specific one, any length thereof may appropriately be selected in accordance with the purpose, and it is preferable to define this length to be 1% to 5%, more preferably 2% to 4% of the length in the gravitational direction of the foreign matter separating chamber. A length of the projection of less than 1% likely causes cyclones in the foreign matter separating chamber, so that the metallic foreign matters may intrude into the exhausting pipe because of centrifugal force due to vortexes of the cyclones; and a length of the projection of more than 5% decreases the cross sectional area of the feeding pipe, so that suction pressure loss becomes increased, which may reduce suction air flow rate, resulting in deterioration of the pulverizing performance. The length of the projection in a more preferable range than the above range provides advantages in preventing contamination of the metallic foreign matters, and ensuring the pulverizing performance.

The length in the gravitational direction of the foreign matter separating chamber denotes a length in a height direction of a foreign matter separating chamber 2 in FIG. 1, for example.

In the foreign matter separating chamber, the connected portion between the exhausting pipe and the foreign matter separating chamber is disposed at the gravitationally higher position than the connected portion between the feeding pipe and the foreign matter separating chamber, and the distance (L) between the connected portion between the exhausting pipe and the foreign matter separating chamber, and the connected portion between the feeding pipe and the foreign matter separating chamber preferably satisfies the following Formula (1):

$$m \times g \times L_h > (1/2) \times m \times v^2 \quad \text{Formula (1)}$$

where in the above Formula (1), $L_h$ denotes a component [m] in the gravitational direction of the distance (L), m denotes mass [g] of the metallic foreign matters, g denotes acceleration of gravity [m/s$^2$], and v denotes speed of the metallic foreign matters [m/s] at the connected portion between the feeding pipe and the foreign matter separating chamber.

Through this configuration, potential energy ($mgL_h$) that moves the metallic foreign matters from the feeding pipe to the exhausting pipe becomes greater than kinetic energy [$(1/2)mv^2$] of the metallic foreign matters entering from the feeding pipe into the foreign matter separating chamber; therefore, the metallic foreign matters cannot reach the height of the exhausting pipe in the foreign matter separating chamber when the metallic foreign matters collide against the inner wall of the foreign matter separating chamber and others, so that the metallic foreign matters unexpectedly spatter toward the exhausting pipe.

The mass m of the metallic foreign matters may be 0.004 g to 4.0 g, for example. The speed v of the metallic foreign matters at the connected portion between the feeding pipe and the foreign matter separating chamber may be 17.5 m/s to 28.0 m/s, more preferably 19.2 m/s to 25.4 m/s.

The material of the foreign matter separating chamber, the feeding pipe, the exhausting pipe, the blocking portion, and the projection is not limited to a specific one, and any material thereof may appropriately be selected in accordance with the purpose, and this material may be stainless steel, for example.

The shape of the foreign matter separating chamber is not limited to a specific one, and any shape thereof may appropriately be selected in accordance with the purpose, and this shape may be cylindrical, for example.

The shape of the feeding pipe is not limited to a specific one, and any shape thereof may appropriately be selected in accordance with the purpose, and this shape may have a circular or oval cross section at a position where the cross sectional area of the feeding pipe becomes minimum (excluding the cross section including the blocking portion), for example.

The shape of the exhausting pipe is not limited to a specific one, and any shape thereof may appropriately be selected in accordance with the purpose, and this shape may have a circular or oval cross section at a position where the cross section area of the exhausting pipe becomes minimum, for example.

The cross sectional area of the foreign matter separating chamber is not limited to a specific one, and any cross sectional area thereof may appropriately be selected in accordance with the purpose, and this cross sectional area may preferably be 0.14 m$^2$ to 0.30 m$^2$, more preferably 0.16 m$^2$ to 0.28 m$^2$, and further more preferably 0.17 m$^2$ to 0.25 m$^2$.

In the case of the foreign matter separating chamber 2 of FIG. 1, for example, the cross sectional area of the foreign matter separating chamber denotes a cross sectional area of a space in the foreign matter separating chamber in a cross section in the perpendicular direction to the gravitational direction.

The cross sectional area of the feeding pipe is not limited to a specific one, and any cross sectional area thereof may appropriately be selected in accordance with the purpose, and this cross sectional area may preferably be 0.017 m$^2$ to 0.042 m$^2$, more preferably 0.018 m$^2$ to 0.039 m$^2$, and further more preferably 0.020 m$^2$ to 0.035 m$^2$.

In the case of the feeding pipe 3 of FIG. 1, for example, the cross sectional area of the feeding pipe denotes a cross sectional area of a space in the feeding pipe in a cross section in the perpendicular direction to the conveyance direction of the raw powder material of toner (to a direction parallel to a pipe center line connecting a center 23 and a center 33).

The cross sectional area of the feeding pipe is not limited to a specific one, and any cross sectional area thereof may appropriately be selected in accordance with the purpose, and this cross sectional area may preferably be 0.020 m$^2$ to 0.059 m$^2$, more preferably 0.022 m$^2$ to 0.054 m$^2$, and further more preferably 0.024 m$^2$ to 0.049 m$^2$.

In the case of the exhausting pipe 4 of FIG. 1, for example, the cross sectional area of the exhausting pipe denotes a cross sectional area of a space in the exhausting pipe in a cross section in the perpendicular direction to the conveyance direction of the raw powder material of toner.

A ratio between the cross sectional area (S1) of the feeding pipe and the cross sectional area (S0) of the foreign matter separating chamber (S1/S0×100(%)) is not limited to a specific one, and any ratio thereof may appropriately be selected in accordance with the purpose, and this ratio may preferably be 10% to 50%, and more preferably 20% to 40%.

The ratio between the cross sectional area (S2) of the exhausting pipe and the cross sectional area (S0) of the foreign matter separating chamber (S2/S0×100(%)) is not limited to a specific one, and any ratio thereof may appropriately be selected in accordance with the purpose, and this ratio may preferably be 10% to 50%, and more preferably 20% to 40%.

The speed of conveyance gas for the raw powder material of toner in the feeding pipe is not limited to a specific one, and any speed thereof may appropriately be selected in accordance with the purpose, and this speed may preferably be 16.0 m/s to 31.0 m/s, more preferably 19.2 m/s to 25.4 m/s. The speed of less than 16.0 m/s encourages adhesion of the raw powder material of toner to the inside of the feeding pipe, which may deteriorate production output as well as may cause clogging of the pipe, resulting in clogging of the feeding pipe with the raw powder material of toner; and the speed of more than 31.0 m/s increases air flow rate, and increases pressure loss, which requires scale-up of equipment for reducing this pressure loss, resulting in requirement of additional investment in equipment, installation space, and incidental equipment. This speed in a more preferable range than the above range provides advantages in investment cost and stable production operation in minimum space.

The speed of the conveyance gas for the raw powder material of toner in the foreign matter separating chamber is not limited to a specific one, and any speed thereof may appropriately be selected in accordance with the purpose, and this speed may preferably be 3.0 m/s or less, more preferably 2.1 m/s to 2.9 m/s. At the speed of the conveyance gas of more than 3.0 m/s, swirling sediment may collide and spatter against the projection formed on the inner side surface of the foreign matter separating chamber. This speed in a more preferable range than the above range provides advantages in suppression of spattering of the metallic foreign matters.

The speed in the foreign matter separating chamber is not necessary to be directly measured in the foreign matter separating chamber, and this speed may be calculated based on the air flow rate from a blower used for conveying the raw powder material of toner, and on the cross sectional area of the foreign matter separating chamber.

The relation between the speed of the conveyance gas for the raw powder material of toner in the feeding pipe (Vin), and the speed of the conveyance gas for the raw powder material of toner in the foreign matter separating chamber (Vout) is not limited to a specific one, and any relation thereof may be defined in accordance with the purpose, and it is preferable that this relation satisfies the following formula: $Vin \geq 8 \times Vout$, in light of separation of the metallic foreign matters from the raw powder material of toner.

The foreign matter separating chamber preferably has no guide plate for guiding a flow of the conveyance gas for the powder toward the exhausting pipe inside the foreign matter separating chamber. Such a guide plate may allow the raw powder material of toner containing the metallic foreign matters to reach the exhausting pipe before the metallic foreign matters are separated from the raw powder material of toner. An example of this plate-like member may be a guiding plate having a surface including one direction that is parallel to this surface, and oriented to an exhausting port that is the connected portion between the exhausting pipe and the foreign matter separating chamber.

Description will be provided on an example of the foreign matter separating unit with reference to drawings. FIG. 1 is a schematic cross sectional view showing an example of the foreign matter separating unit. A foreign matter separating unit 1 of FIG. 1 includes the foreign matter separating chamber 2, the feeding pipe 3 and the exhausting pipe 4. The foreign matter separating chamber 2 has a hollow cylindrical shape. Each of the feeding pipe 3 and the exhausting pipe 4 has a hollow cylindrical shape. The feeding pipe 3 is connected to a lower (gravitationally lower) portion of a side surface (peripheral surface) of the foreign matter separating chamber 2. The connected portion between the feeding pipe 3 and the foreign matter separating chamber 2 has a feeding port 13. The exhausting pipe 4 is connected to a surface on the opposite side to the gravitational direction (top surface) of the foreign matter separating chamber 2. The connected portion between the exhausting pipe 4 and the foreign matter separating chamber 2 has an exhausting port 14.

In FIG. 1, the center 23 of one end of the feeding pipe 3 disposed at the connected portion between the feeding pipe 3 and the foreign matter separating chamber 2 is located at the gravitationally lower position than (below) the center 33 of the other end opposite to this one end of the feeding pipe 3. This configuration can generate disturbance to the air streams, and suppress occurrence of cyclones in the foreign matter separating chamber 2, thereby preventing the metallic foreign matters from being exhausted from the exhausting pipe 4 before the metallic foreign matters are separated from the raw powder material of toner.

Specifically, in FIG. 1, an angle θ formed between the perpendicular direction to the gravitational direction and the pipe center line 43 that connects the center 23 of the one end of the feeding pipe 3 located at the connected portion between the feeding pipe 3 and the foreign matter separating chamber 2, and the center 33 of the other end opposite to this one end of the feeding pipe 3 is defined to be 6°.

The feeding pipe 3 includes a blocking portion 5 on the inner surface of the feeding pipe 3 on the opposite side to the conveyance direction of the raw powder material of toner, and this blocking portion 5 partially reduces the area of the cross section of the feeding pipe 3 in the perpendicular direction to the conveyance direction of the raw powder material of toner.

Figure 2:
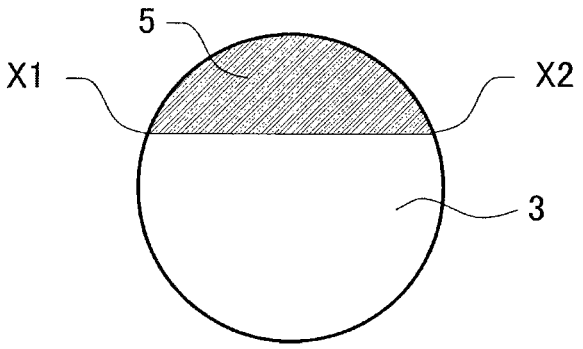
FIG. 2 is a cross sectional view taken along line A-A of FIG. 1.

FIG. 2 is a cross sectional view taken along line A-A of FIG. 1. In FIG. 2, the blocking portion 5 has a bow shape defined by an arc (minor arc) X1 X2 connecting an point X1 and a point X2 on the inner periphery of the feeding pipe 3, and a string X1 X2. The blocking portion 5 partially reduces the area of the cross section of the feeding pipe 3 in the perpendicular direction to the conveyance direction of the raw powder material of toner.

The blocking portion 5 shown in FIG. 2 sequentially blocks the inner surface of the feeding pipe 3 toward the gravitational direction from the opposite direction to the gravitational direction of the inner surface of the feeding pipe 3.

If the feeding pipe 3 has no blocking portion 5, constant swirls occur at the lower portion of the feeding pipe 3 in the foreign matter separating chamber 2, and such constant swirls may bring the raw powder material of toner to be accumulated on a gravitationally lower surface (bottom surface) of the foreign matter separating chamber 2.

The configuration of the feeding pipe 3 having the blocking portion 5 can generate irregular swirls, thereby preventing the raw powder material of toner from being accumulated due to the constant swirls.

The configuration of the feeding pipe 3 having the blocking portion 5 can also suppress occurrence of cyclones in the foreign matter separating chamber 2.

By using the configuration of the feeding pipe 3 having the blocking portion 5 as well as the configuration of disposing the center 23 of the one end of the feeding pipe 3 located at the connected portion between the feeding pipe 3 and the foreign matter separating chamber 2 to be at a gravitationally lower position than the center 33 of the other end opposite the one end of feeding pipe 3, it is possible to more significantly attain the effects of reducing a region where the constant swirls occur, and of preventing the raw powder material of toner from being accumulated on the gravitationally lower surface (bottom surface) of the foreign matter separating chamber 2.

Figure 3:
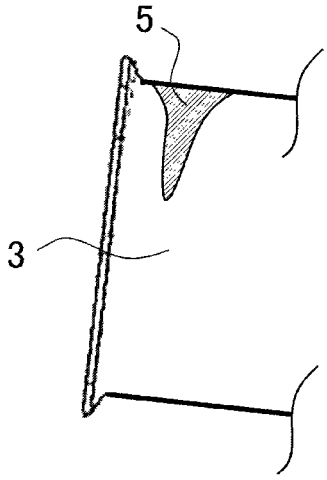
FIG. 3 is a schematic cross sectional view showing another example of a blocking portion formed in a feeding pipe of the foreign matter separating unit.
Figure 4:
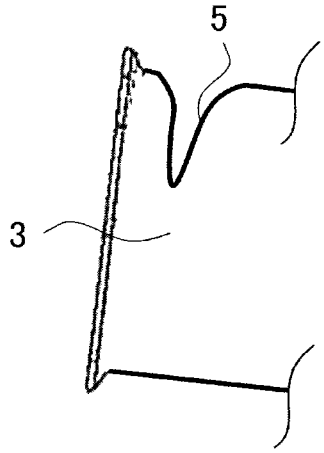
FIG. 4 is a schematic cross sectional view showing another example of the blocking portion formed in the feeding pipe of the foreign matter separating unit.

The shape of the blocking portion 5 is not limited to a specific one, any shape thereof may appropriately be selected in accordance with the purpose as far as this blocking portion partially reduces the area of the cross section of the feeding pipe 3 in the perpendicular direction to the conveyance direction of the raw powder material of toner. The blocking portion 5 may have a plate-like shape as shown in FIG. 1, or may be a projection in a cross sectional view as shown in FIG. 3. The blocking portion 5 may be formed by deforming the pipe wall of the feeding pipe 3, as shown in FIG. 4.

In FIG. 1, the foreign matter separating chamber 2 has a projection 6 projecting inward of the foreign matter separating chamber 2 from the connected portion between the exhausting pipe 4 and the foreign matter separating chamber 2. Even if cyclones occur in the foreign matter separating chamber 2, the projection 6 prevents the metallic foreign matters from intruding into the exhausting pipe 4.

Figure 5:
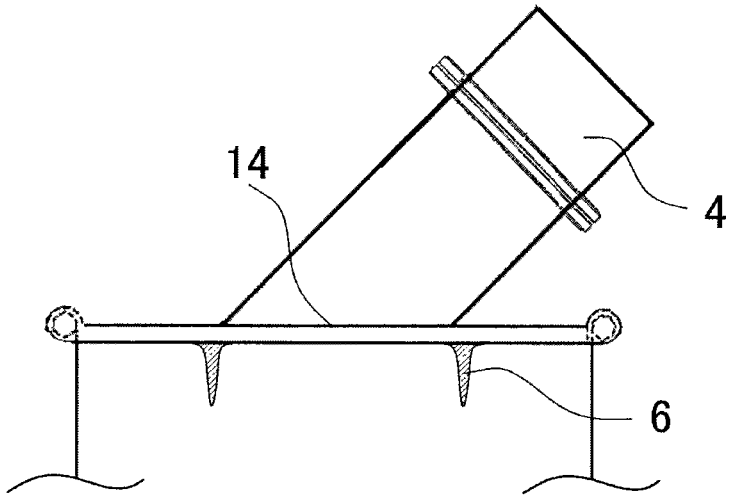
FIG. 5 is a schematic cross sectional view showing another example of a projection formed at a connected portion between an exhausting pipe and the foreign matter separating chamber in the foreign matter separating unit.

The shape of the projection 6 is not limited to a specific one, any shape thereof may appropriately be selected in accordance with the purpose, and this shape may be a projection in a cross sectional view as shown in FIG. 5, for example.

In FIG. 1, the projecting length ($L_6$) of the projection 6 is 3% of the length in the gravitational direction of the foreign matter separating chamber 2.

In the foreign matter separating chamber 2 shown in FIG. 1, the distance (L) between the connected portion between the exhausting pipe 4 and the foreign matter separating chamber 2, and the connected portion between the feeding pipe 3 and the foreign matter separating chamber 2 is defined to satisfy the following Formula (1);

$$m \times g \times L_h > (1/2) \times m \times v^2 \quad \text{Formula (1)}$$

where in the above Formula (1), $L_h$ denotes a component [m] in the gravitational direction of the distance (L), m denotes mass [g] of the metallic foreign matters, g denotes acceleration of gravity [m/s$^2$], and v denotes speed of the metallic foreign matters [m/s] at the connected portion between the feeding pipe and the foreign matter separating chamber.

It can be said that the distance (L) is equal to a minimum distance between the feeding port 13 and the exhausting port 14.

By satisfying Formula (1), potential energy ($mgL_h$) that moves the metallic foreign matters from the feeding pipe 3 to the exhausting pipe 4 becomes greater than kinetic energy [$(1/2)mv^2$] of the metallic foreign matters entering from the feeding pipe 3 into the foreign matter separating chamber 2; therefore, the metallic foreign matters cannot reach the height of the exhausting pipe 4 in the foreign matter separating chamber 2 when the metallic foreign matters collide against the inner wall of the foreign matter separating chamber 2 and others, so that the metallic foreign matters unexpectedly spatter toward the exhausting pipe 4.

Such a foreign matter separating unit may be used in the present invention that excludes the blocking portion 5, the projection 6, and the like from the foreign matter separating unit shown in FIG. 1.

An example of the foreign matter separating unit similar to the foreign matter separating unit shown in FIG. 1 will be described as follows.

Figure 6:
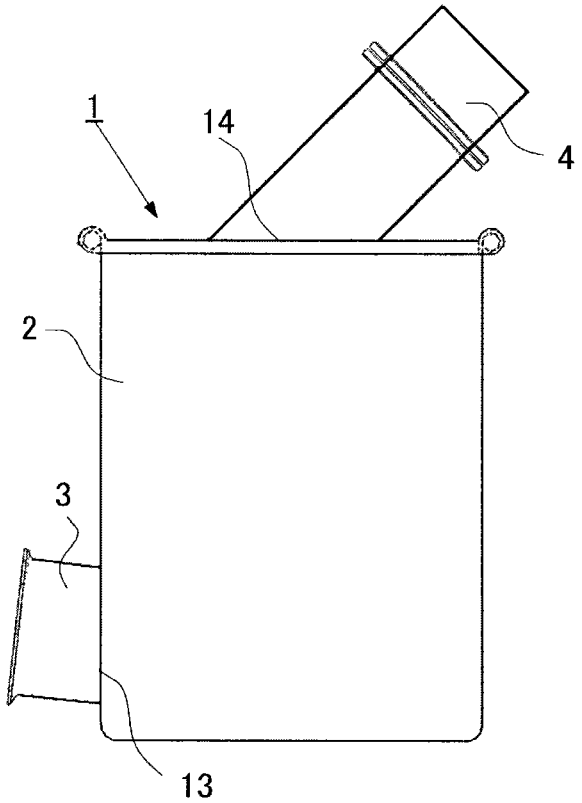
FIG. 6 is a schematic cross sectional view showing another example of the foreign matter separating unit.

The foreign matter separating unit shown in FIG. 6 is an example of the foreign matter separating unit having the same configuration as that of the foreign matter separating unit shown in FIG. 1 except for including no blocking portion and no projection.

Figure 7:
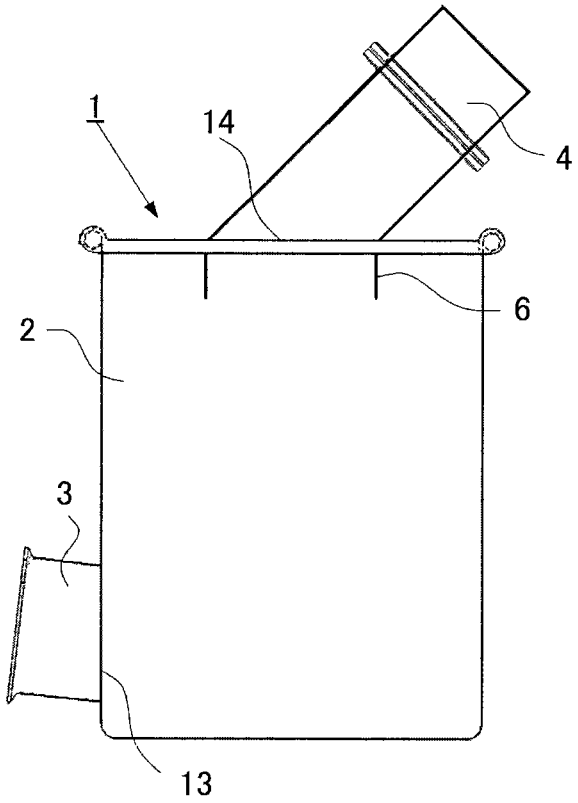
FIG. 7 is a schematic cross sectional view showing another example of the foreign matter separating unit.

The foreign matter separating unit shown in FIG. 7 is an example of the foreign matter separating unit having the same configuration as that of the foreign matter separating unit shown in FIG. 1 except for including no blocking portion.

Figure 8:
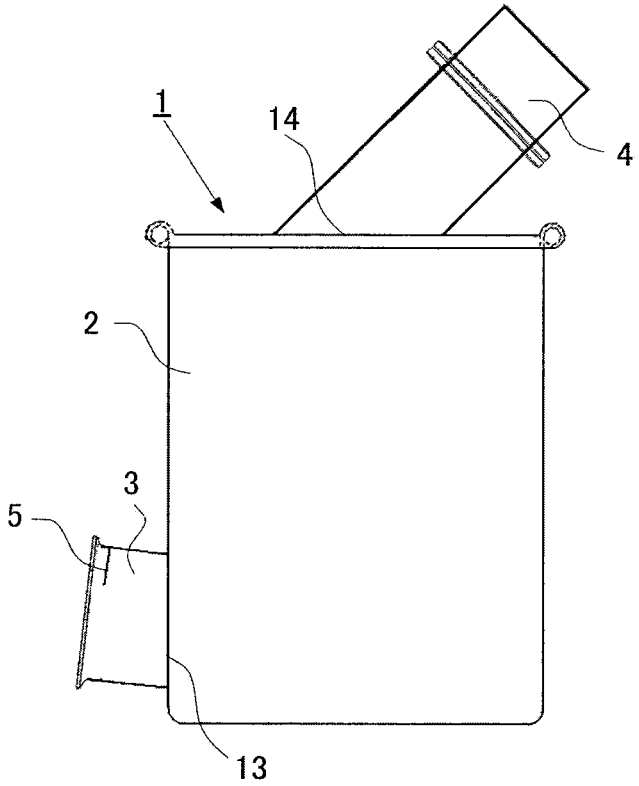
FIG. 8 is a schematic cross sectional view showing another example of the foreign matter separating unit.

The foreign matter separating unit shown in FIG. 8 is an example of the foreign matter separating unit having the same configuration as that of the foreign matter separating unit shown in FIG. 1 except for including no projection.

Figure 9:
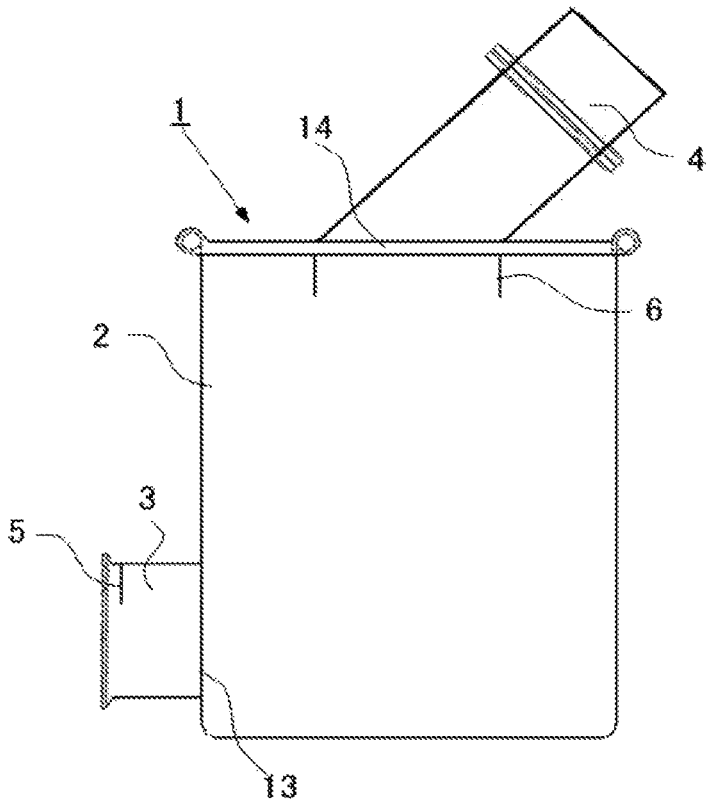
FIG. 9 is a schematic cross sectional view showing another example of the foreign matter separating unit.

The foreign matter separating apparatus shown in FIG. 9 is an example of the foreign matter separating apparatus having the same configuration as that of the foreign matter separating apparatus shown in FIG. 1 except for defining an angle of 0° as the angle (θ) formed between the perpendicular direction to the gravitational direction and the pipe center line 43 that connects the center 23 of the one end of the feeding pipe 3 located at the connected portion between the feeding pipe 3 and the foreign matter separating chamber 2, and the center 33 of the other end opposite to this one end of the feeding pipe 3.

The shape of the foreign matter separating unit of the present invention is not limited to the shapes shown in FIG. 1 to FIG. 9, or to a specific one, any shape thereof may appropriately be selected in accordance with the purpose as far as this foreign matter separating unit includes a foreign matter separating chamber that can separate the metallic foreign matters contained in the raw powder material of toner from the raw powder material of toner using gravity, and foreign matter separating units using gravity set forth in JP-A No. 2000-416, JP-A No. 10-249120, JP-A No. 09-276634, and JP-A No. 06-55022 may be used, for example.

Figure 10:
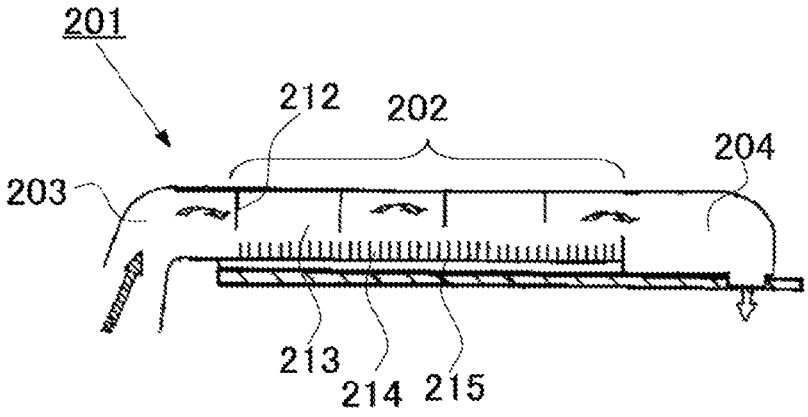
FIG. 10 Related Art
FIG. 10 is a schematic cross sectional view showing another example of the foreign matter separating unit.

Brief description will be provided on an example of these foreign matter separating units with reference to drawings. A foreign matter separating unit 201 shown in FIG. 10 is an example of a foreign matter separating unit similar to that set forth in JP-A No. 2000-416. The foreign matter separating unit 201 shown in FIG. 10 includes a foreign matter separating chamber 202, a feeding pipe 203, and an exhausting pipe 204. The foreign matter separating chamber 202 is provided with a sediment separating unit 213 formed by impact plates 212 disposed to an upper portion of the chamber. A gas reservoir 214 is formed by grid-like plates 215 projectingly disposed in the lower portion of the foreign matter separating chamber 202.

The foreign matter separating chamber 202, the feeding pipe 203, and the exhausting pipe 204 of the foreign matter separating unit 201 are made of a single pipe, and they are formed by partitioning the foreign matter separating chamber 202 by using the impact plates 212 and the grid-like plates 215.

In the foreign matter separating unit 201 of FIG. 10, when the raw powder material of toner containing the metallic foreign matters is fed from the feeding pipe 203 into the foreign matter separating chamber 202, the raw powder material of toner collides against the impact plates 212, and then metallic foreign matters drop down due to gravity, and are accumulated in the gas reservoir 214 below. The raw powder material of toner collides against the plural impact plates 212, so that the metallic foreign matters mixed in the raw powder material of toner drop down, and are accumulated in the gas reservoir 214 without reaching the exhausting pipe 204.

On the other hand, the raw powder material of toner from which the metallic foreign matters are separated passes between the impact plates 212 and the grid-like plates 215, and is exhausted from the exhausting pipe 204.

Figure 11:
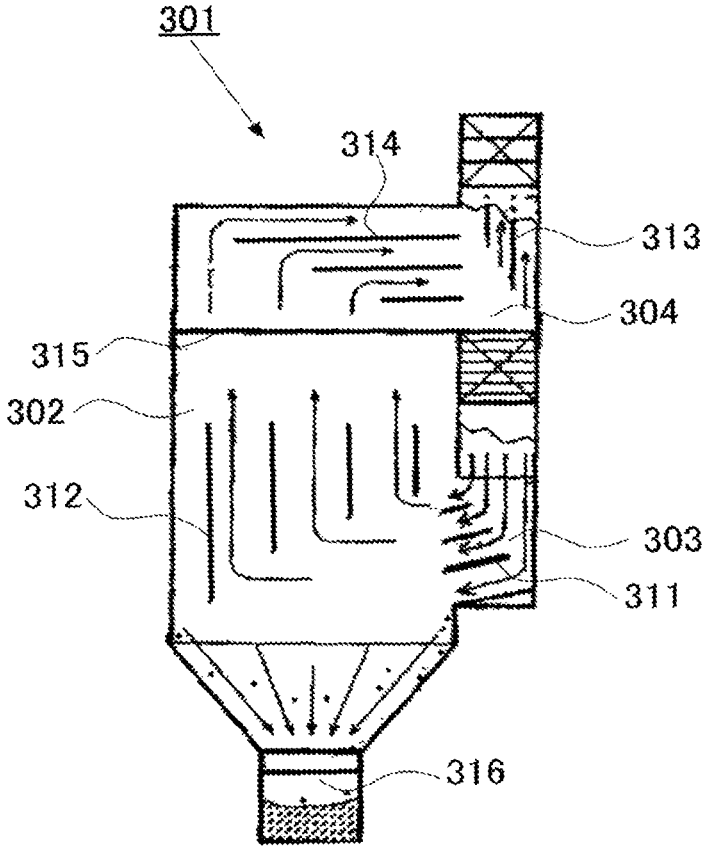
FIG. 11 Related Art
FIG. 11 is a schematic cross sectional view showing another example of the foreign matter separating unit.

A foreign matter separating unit 301 shown in FIG. 11 is an example of a foreign matter separating unit similar to that set forth in JP-A No. 10-249120. The foreign matter separating unit 301 shown in FIG. 11 includes a foreign matter separating chamber 302, a feeding pipe 303, and an exhausting pipe 304. The feeding pipe 303 is connected to a middle portion of a side surface of the foreign matter separating chamber 302. The exhausting pipe 304 is connected to an upper portion of the foreign matter separating chamber 302. The foreign matter separating chamber 302, the feeding pipe 303, and the exhausting pipe 304 are provided with gas distributors 311, 312, 313, and 314, respectively. At the connected portion between the foreign matter separating chamber 302 and the exhausting pipe 304, a filter 315 that allows the raw powder material of toner to pass therethrough, but prevents the metallic foreign matters greater than the raw powder material of toner from passing therethrough.

The raw powder material of toner containing the metallic foreign matters, which is fed from the feeding pipe 303 into the foreign matter separating chamber 302, is separated from the metallic foreign matters in the foreign matter separating chamber 302 using gravity. The metallic foreign matters separated from the raw powder material of toner are collected in a collecting unit 316 disposed at a lower portion of the foreign matter separating chamber 302. The raw powder material of toner separated from the metallic foreign matters is exhausted from the exhausting pipe 304.

Figure 12:
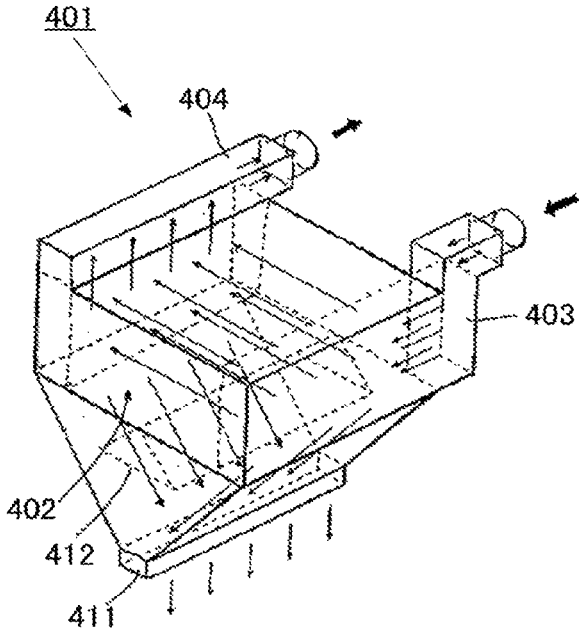
FIG. 12 Related Art
FIG. 12 is a schematic perspective view showing another example of the foreign matter separating unit.

A foreign matter separating unit 401 shown in FIG. 12 is an example of a foreign matter separating unit similar to that set forth in JP-A No. 6-55022. The foreign matter separating unit 401 shown in FIG. 12 includes a foreign matter separating chamber 402, a feeding pipe 403, and an exhausting pipe 404. The feeding pipe 403 is connected to a side surface of the foreign matter separating chamber 402. The exhausting pipe 404 is connected at a position opposite to the feeding pipe 403 on the side surface of the foreign matter separating chamber 402. A collecting unit 411 is disposed at a lower portion of the foreign matter separating chamber 402. The foreign matter separating chamber 402 is provided with an air-stream guide plate 412 having a mountain-like triangular cross section extending across the feeding pipe 403 and the exhausting pipe 404.

The raw powder material of toner containing the metallic foreign matters, which is fed from the feeding pipe 403 into the foreign matter separating chamber 402, is separated from the metallic foreign matters in the foreign matter separating chamber 402 using gravity. The metallic foreign matters separated from the raw powder material of toner are collected in the collecting unit 411 disposed at a lower portion of the foreign matter separating chamber 402. The raw powder material of toner separated from the metallic foreign matters is exhausted from the exhausting pipe 404.

<<Raw Powder Material of Toner>>

The raw powder material of toner is not limited to a specific one, and any raw powder material of toner may appropriately be selected in accordance with the purpose as far as this material is raw powder material for use in producing toner.

The raw powder material of toner may contain at least binder resin and colorant, and may also contain other components if necessary.

—Binder Resin—

The binder resin is not limited to a specific one, and any binder resin may appropriately be selected in accordance with the purpose, and this binder resin may be, for example, polyester resin, (meth)acrylic resin, styrene-(meth) acrylic copolymer resin, epoxy resin, and COC (cyclic olefin resin (such as TOPAS-COC of Ticona)), etc. Among them, it is preferable to use styrene-(meth) acrylic copolymer resin, and polyester resin. They may be used on a standalone basis, or in combination.

—Colorant—

The colorant is not limited to a specific one, and any colorant may appropriately be selected in accordance with the purpose, and this colorant may be a black pigment, a yellow pigment, a magenta pigment, and a cyan pigment, etc., for example.

The black pigment may be used in black toner, for example. The black pigment may be carbon black, copper oxide, manganese dioxide, aniline black, activated carbon, nonmagnetic ferrite, magnetite, nigrosin dye, and iron black, etc., for example.

The yellow pigment may be used in yellow toner, for example. The yellow pigment may be C.I. pigment yellow 74, 93, 97, 109, 128, 151, 154, 155, 166, 168, 180, 185, Naphthol yellow S, Hansa yellow (10G, 5G, G), cadmium yellow, yellow iron oxide, yellow ocher, chrome yellow, titan yellow, and poly azo yellow, etc., for example.

The magenta pigment may be used in magenta toner, for example. The magenta pigment may be a quinacridone pigment, and a monoazo pigment such as C.I. pigment red 48:2, 57:1, 58:2, 5, 31, 146, 147, 150, 176, 184, 269, etc., for example.

The cyan pigment may be used in cyan toner, for example. The cyan pigment may be a Cu-phthalocyanine pigment, a Zn-phthalocyanine pigment, and an Al-phthalocyanine pigment, for example.

The weight average particle diameter of the raw powder material of toner is not limited to a specific one, and any weight average particle diameter thereof may appropriately be selected in accordance with the purpose, and this weight average particle diameter is preferably 20 μm to 500 μm.

The weight average particle diameter may be measured by a laser diffraction particle size distribution measuring apparatus (e.g. SALD-3000J of Shimadzu Corporation).

<Pulverizing Unit, and Pulverizing Step>

The pulverizing unit is not limited to a specific one, and any pulverizing unit may appropriately be selected in accordance with the purpose as far as this is a pulverizing unit including a rotor.

The pulverizing step is not limited to a specific one, and any pulverizing step may appropriately be selected in accordance with the purpose as far as this is a step of pulverizing the raw powder material of toner exhausted from the exhausting pipe in the foreign matter separating step by using the pulverizing unit including a rotor.

An example of the pulverizing unit including a rotor may be a unit, having a rotor, for pulverizing the raw powder material of toner by using at least any one of collision between the rotor and the raw powder material of toner; collision of the raw powder material of toner against each other; and effect exerting by the rotor and a stator disposed outward of the outer peripheral surface of the rotor with a gap between the stator and the rotor, for example.

As the pulverizing unit including a rotor, it is preferable to use a pulverizing unit including a rotor as well as a stator disposed outward of the outer peripheral surface of the rotor with a gap between the stator and the rotor, which can pulverize raw powder material into fine powder, and is suitable for pulverizing the raw powder material of toner.

The rotor preferably has, in succession in the peripheral direction of the outer peripheral surface of the stator, plural projections and recesses in parallel with the rotational axis.

The stator preferably has, in succession in the peripheral direction of the inner peripheral surface of the rotor, plural projections and recesses in parallel with the rotational axis of the rotor.

The shapes of the projections and recesses of the rotor and the stator are not limited to specific ones, and any shapes thereof may appropriately be selected.

Examples of the pulverizing unit including a rotor may be pulverizing units having rotors set forth in JP-A No. 2005-21768, JP-A No. 11-319601, JP-A No. 2004-330062, JP-A No. 11-276916, and JP-A No. 2007-041496, for example.

Examples of the pulverizing unit including a rotor may be a Turbo Mill (of Freund-Turbo Corporation, for example), a Fine Mill (of Nippon Coke & Engineering Co., Ltd., for example), Kryptron (of Kawasaki Heavy Industries, Ltd.), ACM Pulverizer, AP Pulverizer (of Hosokawa Micron Corporation), Atomizer (Tokyo Atomizer M.F.G. Co., Ltd.), Tornado Mill (Sansho Industry Co., Ltd.), for example.

Figure 13:
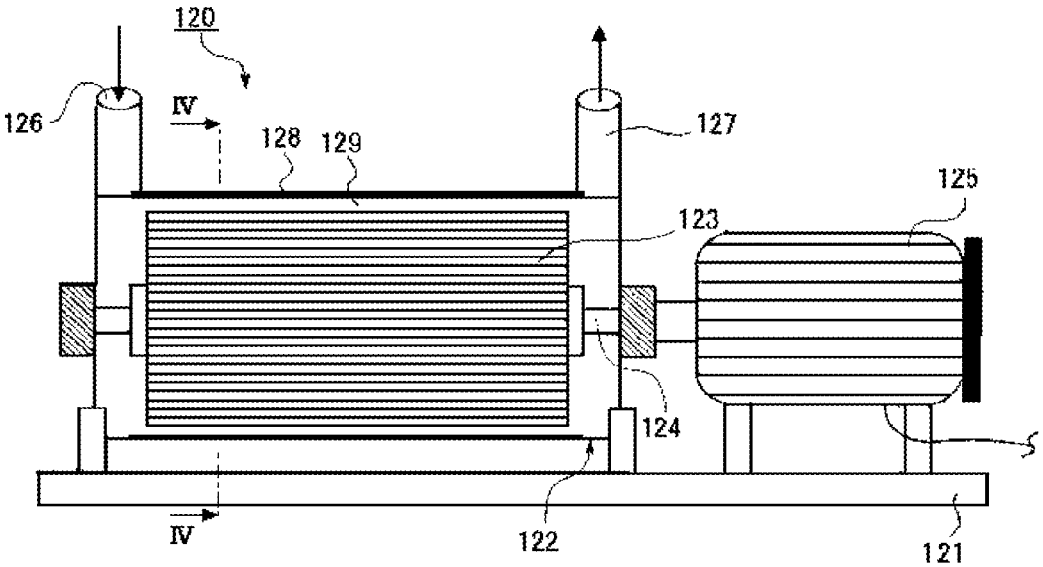
FIG. 13 is a schematic cross sectional view showing an example of a mill.

Herein, description will be provided on an example of the pulverizing unit including a rotor with reference to drawings. FIG. 13 is a schematic a cross sectional view showing an example of the pulverizing unit including a rotor (mill). A mill 120 shown in FIG. 13 includes a casing 122 having a cylindrical shape horizontally disposed on a base 121. Inside the casing 122, a cylindrical rotor 123 is horizontally disposed, the axis of this rotor 123 is disposed coaxially with the axis of the casing 122, and one end of the rotor 123 is connected to an output shaft of a motor 125. The casing 122 has a supply port 126 for supplying the raw powder material of toner along with the conveyance gas into the mill on one end of the casing 122 (its left end in FIG. 13), and has an exhausting port 127 connected to a suction blower at a right end of the casing 122 (its right end in FIG. 13). A stator 128 integrated with the casing 122 is disposed around the rotor 123, and a gap 129 is provided between the stator 128 and the rotor 123. It is preferable to apply lining treatment to both or either one of the rotor 123 and the stator 128 with material excellent in wear resistance such as titanium.

Figure 14:
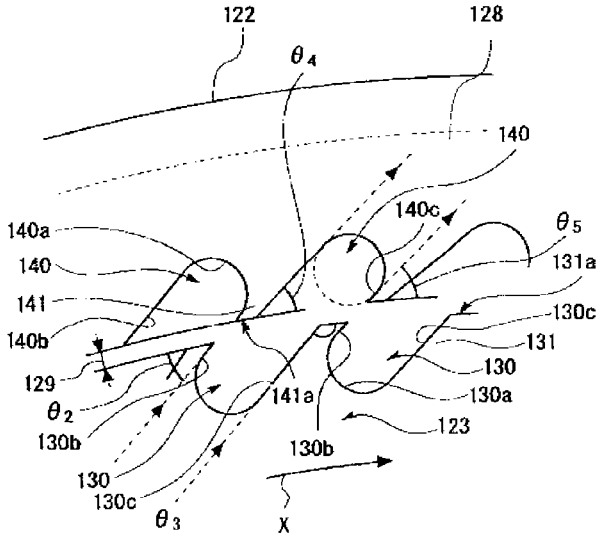
FIG. 14 is a partial cross sectional view taken along line IV-IV of FIG. 13, and is a drawing showing an example of shapes of a rotor and a stator of the mill.

FIG. 14 is a partial cross sectional view taken along line IV-IV of FIG. 13, showing an example of the shapes of the rotor and the stator of the mill.

As shown in FIG. 14, on the outer surface of the rotor 123, plural recess portions 130 extending in the axial direction are disposed in succession with intervals of several millimeters in the peripheral direction, projecting portions 131 extending in the axial direction are each disposed between every adjacent two recess portions 130, and a peak surface 131*a* of each projecting portion 131 is constituted by an arc surface whose center of curvature is the axial line of the rotor 123. Each recess portion 130 of the rotor 123 obliquely extends from its bottom portion in the preceding direction of the rotational direction X of the rotor 123. Specifically, each recess portion 130 of the rotor 123 is constituted by a semicircular wall 130*a* at the bottom portion, a subsequent wall 130*b* obliquely extending from one end of the bottom wall 130*a* (subsequent end in the rotational direction X of the rotor 123) toward the tangential line in the preceding direction of the rotational direction X, and a preceding wall 130*c* obliquely extending from the other end of the bottom wall 130*a* (preceding end in the rotational direction X of the rotor 123) toward the tangential line in the preceding direction of the rotational direction X. More specifically, the subsequent wall 130*b* intersects the outer peripheral surface of the rotor 123 at an angle of $\theta_2$, and the preceding wall 130*c* intersects the outer peripheral surface of the rotor 123 at an angle of $\theta_3$. The intersectional angle $\theta_2$ of the subsequent wall 130*b* is selected from 30° to 80°, and the intersectional angle $\theta_3$ of the preceding wall 130*c* is selected from 30° to 80°.

As shown in FIG. 14, on the inner surface of the stator 128, plural recess portions 140 extending in the axial direction are disposed in succession with intervals of several millimeters in the peripheral direction, projecting portions 141 extending in the axial direction are each disposed between every adjacent two recess portions 140, and a peak surface 141*a* of each projecting portion 141 is constituted by an arc surface whose center of curvature is the axial line of the rotor 123. Each recess portion 140 of the stator 128 obliquely extends from its bottom portion in the subsequent direction of the rotational direction X of the stator 128. Specifically, each recess portion 140 of the stator 128 is constituted by a semicircular wall 140*a* at the bottom portion, a subsequent wall 140*b* obliquely extending from one end of the bottom wall 140*a* (subsequent end in the rotational direction X) toward the tangential line in the subsequent direction of the rotational direction X, and a preceding wall 140*c* obliquely extending from the other end of the bottom wall 140*a* (preceding end in the rotational direction X) toward the tangential line in the subsequent direction of the rotational direction X. More specifically, the subsequent wall 140*b* intersects the inner peripheral surface of the stator 128 at an angle of $\theta_4$, and the preceding wall 140*c* intersects the inner peripheral surface of the stator 128 at an angle of $\theta_5$. The intersectional angle $\theta_4$ of the subsequent wall 140*b* is selected from 30° to 80°, and the intersectional angle $\theta_5$ of the preceding wall 140*c* is selected from 30° to 80°.

According to the above mill 120, the raw powder material of toner from the supply port 126 passes through the mill along with the conveyance gas by suction force generated by a blower connected to the exhausting port 127, and is subjected to pulverizing action during passing through the mill so as to be pulverized, and then is exhausted from the exhausting port 127 to the outside.

In pulverization carried out inside the mill 120, stable helical air streams are obtained in the gap 129 between the rotor 123 and the stator 128, and plural swirls having high vorticity are constantly generated in the recess portions 140 each having a U shape of the stator 128, thereby producing products of micron order having a relatively narrow particle size distribution.

In FIG. 13, the rotor and the stator are horizontally disposed, but they may be vertically disposed.

Figure 15:
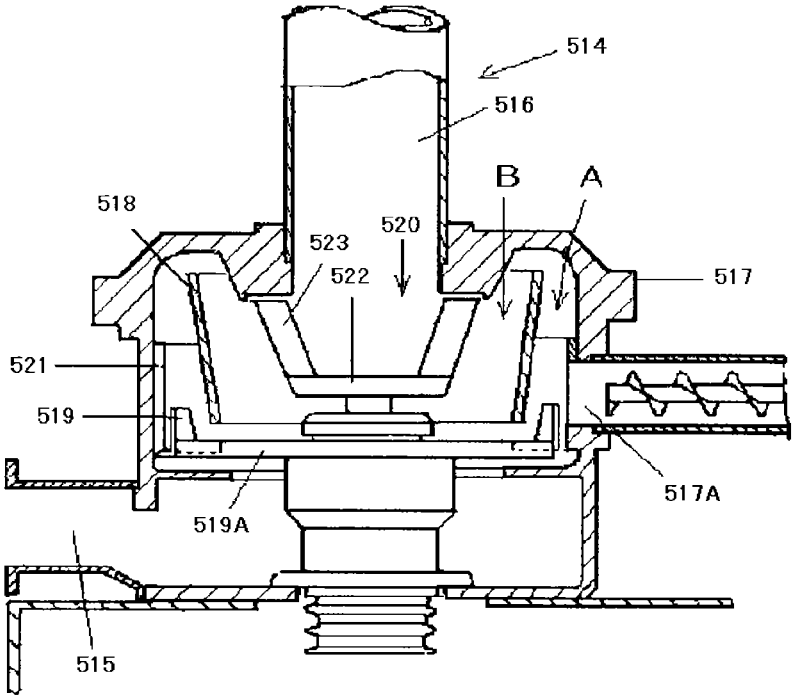
FIG. 15 is a schematic cross sectional view showing another example of the mill.

Herein, description will be provided on another example of the pulverizing unit including a rotor with reference to drawings. FIG. 15 is a schematic cross sectional view showing another example of the pulverizing unit including a rotor (mill). The mill shown in FIG. 15 includes a body 517 provided with a gas introducing port 515 at a lower portion thereof, and an exhausting port 516 for exhausting the gas and the raw powder material of toner at an upper portion thereof. The inside of the body 517 is partitioned by a cylindrical member 518 into a pulverizing chamber A on the outward side and a classifying chamber B on the inward side. The pulverizing chamber A incorporates a rotor 519A including pulverizing members 519, and is communicated with the gas introducing port 515 at the lower portion thereof. The classifying chamber B is communicated with the exhausting port 516 via a classifying mechanism 520 that classifies the raw powder material of toner into rough powder and fine powder, and allows only the fine powder to pass therethrough. The raw powder material of toner is fed from a feeding port 517A disposed at a lateral side of the body 517 into the pulverizing chamber A. At the exhausting port 516, exhausting by suction is carried out toward the outside through a dust collector incorporating a bug filter (not shown). The rotor 519A is rotatable around its vertical axis, and the plural pulverizing members 519 of a vertical hammer type are disposed around the outer periphery of the rotor 519A with intervals between the pulverizing members 519 and a liner 521 mounted on the inner wall of the pulverizing chamber A. The fed raw material is subjected to mechanical impact applied from the pulverizing members 519 so as to be pulverized in the pulverizing chamber A. It is preferable to limit the circumferential speed of the rotor 519A to be 150 m/s or less so as to prevent excessive pulverizing.

The classifying mechanism 520 has a structure having plural standing classifying vanes 523 uprightly disposed around the outer periphery of a rotary member 522 which is rotatable around its vertical axis, and the classifying mechanism 520 classifies the raw powder material into fine powder and rough powder by using a difference between the conveyance force of air streams flowing from the classifying chamber B toward the exhausting port 516 so as to affect pulverized objects, and centrifugal force applied by the rotary member 522. Specifically, among the pulverized objects introduced from the pulverizing chamber A into the classifying chamber B, fine powder more greatly subjected to the conveyance force of the air streams passes through the classifying vanes 523, and then is exhausted from the exhausting port 516; and rough powder more greatly subjected to the centrifugal force is returned to the pulverizing chamber A from the lower portion of the cylindrical member 518 without passing through the classifying vanes 523.

Figure 16:
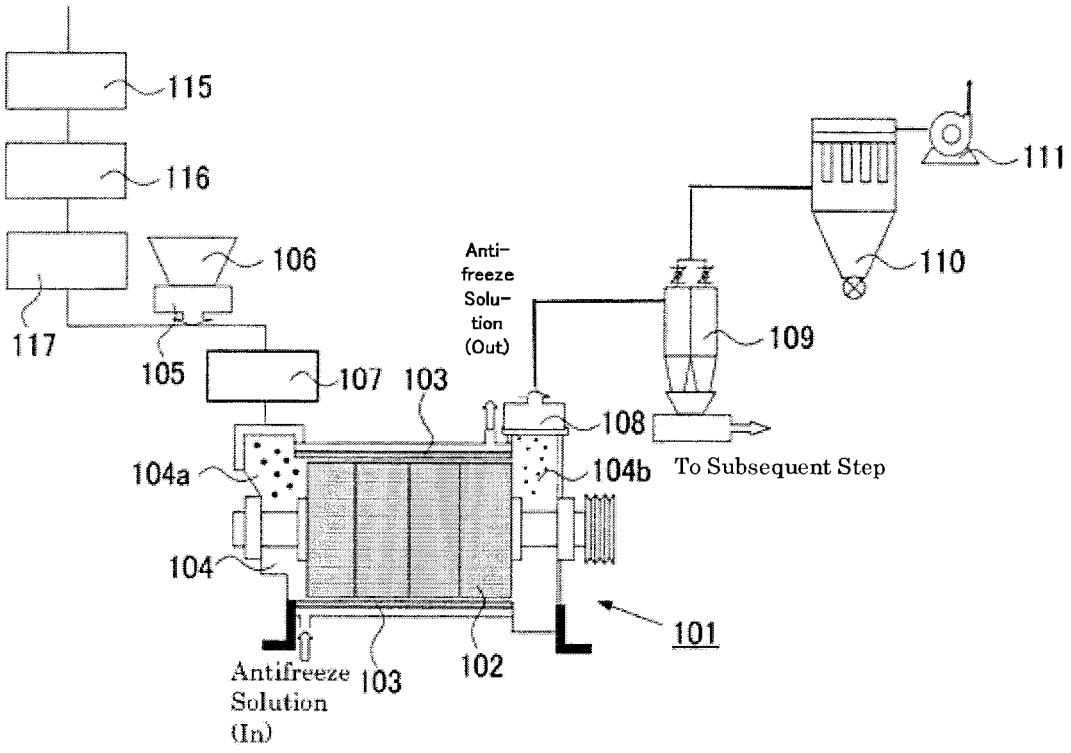
FIG. 16 is a schematic diagram showing an example of a flow of the toner producing method of the present invention.

Description will be provided on an example of the toner producing method according to the present invention with reference to drawings. FIG. 16 is a schematic diagram showing an example of a flow of the toner producing method according to the present invention. In the toner producing method using a mechanical mill 101, gas (e.g. air) supplied (introduced) into a first temperature controller 115 is cooled down to a certain temperature, and then is supplied to a dehumidifier 116. The gas supplied to the dehumidifier 116 is dehumidified to a predetermined dew point temperature, and thereafter is supplied to a second temperature controller 117. The gas supplied to the second temperature controller 117 is cooled down to a predetermined mechanical mill inlet air temperature. Raw powder material of toner 105 supplied from a supply port 106 is supplied along with the temperature-controlled and dehumidified gas into a foreign matter separating unit 107 so as to separate the raw powder material of toner from the metallic foreign matters mixed in the raw powder material of toner. The raw powder material of toner 105 separated from the metallic foreign matters is supplied to a mechanical mill 101, and is pulverized there. Pulverized objects 108 processed in a pulverizing chamber 104 is collected in a cyclone 109, and thereafter is further processed in the subsequent step. Toner that has not been collected in the cyclone 109 is collected in a bug filer 110, and is then reused or disposed of.

In FIG. 16, the numerical reference 111 denotes a blower. The gas sent from the blower 111 is mostly supplied to an introducing portion of the first temperature controller 115 although it depends on the load of the mechanical mill 101. In this case, since the gas is recycled, it is possible to save energy particularly required for dehumidification. In FIG. 16, the numerical reference 102 denotes a rotor, the numerical reference 103 denotes a stator, the numerical reference 104*a* denotes an inlet of the mill, and the numerical reference 104*b* denotes an outlet of the mill.

EXAMPLES

Hereinafter, description will be provided on Examples of the present invention, but the present invention is not limited to the following Examples at all.

Example 1

Production of Toner

Toner was produced through an apparatus configuration shown in FIG. 16.

—Production of Raw Powder Material of Toner—

A mixture containing the following composition was melt-kneaded and cooled, and thereafter, was further roughly pulverized into rough pulverized objects (raw powder material of toner) having a weight average particle diameter of 400 μm.

[Composition]

Styrene-acrylic copolymer 100 parts by mass
Carbon black 10 parts by mass
Polypropylene 5 parts by mass
Zinc salicylate 2 parts by mass —Foreign Matter Separating Step—

Figure 17:
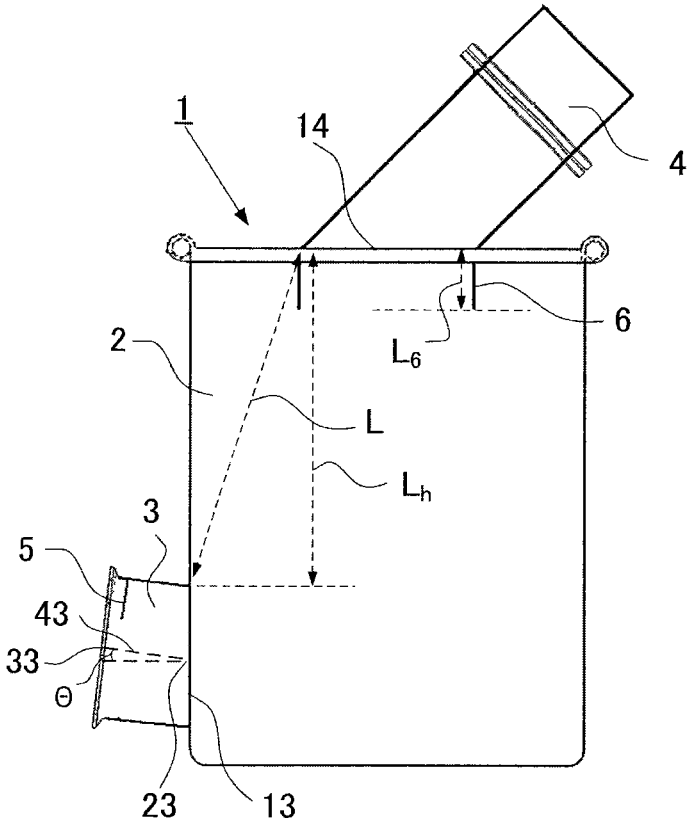
FIG. 17 is a schematic cross sectional view showing a foreign matter separating unit used in Examples.

The foreign matter separating step was carried out through the foreign matter separating unit shown in FIG. 17 using the above obtained raw powder material of toner. For evaluation, stainless balls each having a diameter of 1 mm were used as the metallic foreign matters. This size was defined in consideration of an average size of the metallic foreign matters generated in the kneading machine.

Mixture made by mixing the raw powder material of toner of 100 parts by mass with the metallic foreign matters of 0.1 parts by mass (2500 metallic foreign matters per 10 kg of the raw powder material of toner) was conveyed to the foreign matter separating unit at a supply rate of 10 kg/h of the raw powder material of toner using the blower so as to carry out the foreign matter separating step.

The device configuration of the foreign matter separating unit that was used in the Examples, and each condition of the foreign matter separating step are described as follows.

[Apparatus Configuration of Foreign Matter Separating Unit]

The foreign matter separating chamber 2 has a cylindrical shape whose diameter is 470 mm, and whose height is 627 mm.

The feeding pipe 3 has a cylindrical shape whose diameter is 160 mm.

The exhausting pipe 4 has an oval cylindrical shape whose major axis is 210 mm, and whose minor axis is 150 mm.

The feeding pipe 3 is connected to the lower portion of the side surface of the foreign matter separating chamber 2.

The exhausting pipe 4 is connected to the top surface of the foreign matter separating chamber 2.

The angle θ formed between the perpendicular direction to the gravitational direction and the pipe center line 43 that connects the center 23 of the one end of the feeding pipe 3 located at the connected portion between the feeding pipe 3 and the foreign matter separating chamber 2, and the center 33 of the other end opposite to this one end of the feeding pipe 3 is defined to be 6°.

The feeding pipe 3 is provided with the blocking portion 5. The blocking portion 5, as shown in FIG. 2, has a structure that sequentially blocks the inner surface of the feeding pipe 3 toward the gravitational direction from the direction opposite to the gravitational direction of the inner surface of the feeding pipe 3. The blocking portion 5 reduces the area of the cross section of the feeding pipe 3 in the perpendicular direction to the conveyance direction of the raw powder material of toner by 25%. The thickness of the blocking portion 5 is defined to be 3 mm.

In the foreign matter separating chamber 2, a projection 6 projecting inward of the foreign matter separating chamber 2 is formed at the connected portion between the exhausting pipe 4 and the foreign matter separating chamber 2. The projection 6 has a projecting length ($L_6$) of 20 mm, which is 3% of the height of 627 mm of the foreign matter separating chamber 2.

The distance (L) between the connected portion between the exhausting pipe 4 and the foreign matter separating chamber 2 and the connected portion between the feeding pipe 3 and the foreign matter separating chamber 2 is defined to satisfy the above Formula (1).

The speed of the conveyance gas (Vin) for the raw powder material of toner in the feeding pipe 3 is defined to be 25.0 m/s.

The speed of the conveyance gas (Vout) for the raw powder material of toner in the foreign matter separating chamber 2 is defined to be 2.5 m/s.

—Pulverizing Step—

The pulverizing step was carried out subsequently to the foreign matter separating step.

Pulverizing was carried out by using the mill (mechanical mill) shown in FIG. 13. The gap 129 between the rotor 123 and the stator 128 was defined to be 1 mm. The circumferential speed of the rotor 123 was defined to be 94.2 m/s (3,000 rpm). The supply rate of the raw powder material of toner to the mill was defined to be 10 kg/h.

Fine powder was removed using the cyclone from pulverized objects pulverized by the mill, and additive was further added therein so as to obtain toner.

The obtained toner had a volume average particle diameter of 9.5 μm.

[Evaluation]

The following evaluation was conducted. The result is shown in Table 1-1.

<Foreign Matter Separating Rate>

After one-hour production of toner, mass of the metallic foreign matters remaining in the foreign matter separating chamber was measured, and the foreign matter separating rate (%) from the raw powder material of toner in the foreign matter separating step was found by using the following formula.

$$\text{Foreign matter separating rate (\%)}=100\times M1/M0$$

M0: Mass of the metallic foreign matters fed in the foreign matter separating chamber during the evaluation M1: Mass of the metallic foreign matters remaining in the foreign matter separating chamber after the evaluation <Amount of Electric Charge of Toner>

The toner and a carrier were used as developing powder with a toner density of 7 mass %, and this developing powder was left for two hours in an environment at a temperature of 40° C., and at humidity of 70%. Subsequently, initial chemical of 6 g was obtained by putting the above developing powder in a metal gauge, and then agitating and mixing this by an agitator at a rotational speed of 285 rpm for a predetermined time; and then 1 g of the developing powder was weighed from the initial chemical of 6 g. The amount of electric charge of the toner in this developing powder of 1 g was measured by using a blow-off charge measurement apparatus of Toshiba Chemical Corporation.

<Damage on Photoreceptor>

10000-sheet image formation was conducted on the obtained toner by using a chart with image area ratio of 8% through AFICIO MP301 SPF of Ricoh Company Ltd., and a state of the photoreceptor after the image formation was observed; and the result of the observation was evaluated on the follow criteria.

[Evaluation Criteria]

A: No flaw on photoreceptor

B: Some flaws on photoreceptor (1 to 4 points)

C: Flaws on photoreceptor (5 points or more)

Examples 2 to 6

In Example 1, the production and evaluation of the toner were conducted in the same manner as that of Example 1 other than using different supply rates of the raw powder material of toner and different conditions of the mill as set forth in Table 1-1. The result thereof is shown in Table 1-1.

Comparative Example 1

In Example 1, the production and evaluation of the toner were conducted in the same manner as that of Example 1 other than using no foreign matter separating unit, and carrying out no foreign matter separating step. The result thereof is shown in Table 1-2.

Comparative Examples 2 to 6

In Comparative Example 1, the production and evaluation of the toner were conducted in the same manner as that of Comparative Example 1 other than using different supply rates of the raw powder material of toner and different conditions of the mill as set forth in Table 1-2. The result thereof is shown in Table 1-2.

Examples 7 to 21

In Example 1, the production and evaluation of the toner were conducted in the same manner as that of Example 1 other than using different conditions of the foreign matter separating unit as set forth in Table 1-3 and Table 1-4. The result thereof is shown in Table 1-3 and Table 1-4.

TABLE 1-1

| | | | Ex. 1 | Ex. 2 | Ex. 3 | Ex. 4 | Ex. 5 | Ex. 6 |
|---|---|---|---|---|---|---|---|---|
| Supply Rate of Raw Powder Material of Toner | | kg/h | 10 | 20 | 10 | 20 | 10 | 20 |
| Foreign Matter Separating Unit | Vin | m/s | 25.0 | 25.0 | 25.0 | 25.0 | 25.0 | 25.0 |
| | Vout | m/s | 2.5 | 2.5 | 2.5 | 2.5 | 2.5 | 2.5 |
| Mill | Circumferential Speed of Rotor | m/s | 94.2 | 94.2 | 110.0 | 110.0 | 125.6 | 125.6 |
| Foreign Matter Separating Rate | | % | 100 | 100 | 100 | 100 | 100 | 100 |
| Electric Charge of Toner | | μC/g | 25.5 | 25.2 | 25.6 | 25.3 | 25.5 | 25.7 |
| Damage on Photoreceptor | | | A | A | A | A | A | A |

TABLE 1-2

| | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|
| Supply Rate of Raw Powder Material of Toner | kg/h | 10 | 20 | 10 | 20 | 10 | 20 |
| Mill Circumferential Speed of Rotor | m/s | 94.2 | 94.2 | 110.0 | 110.0 | 125.6 | 125.6 |
| Foreign Matter Separating Rate | % | 0 | 0 | 0 | 0 | 0 | 0 |
| Electric Charge of Toner | μC/g | 23.1 | 24.5 | 25.0 | 24.1 | 24.9 | 25.1 |
| Damage on Photoreceptor | | B | C | B | C | C | C |

TABLE 1-3

| | | | Ex. 7 | Ex. 8 | Ex. 9 | Ex. 10 | Ex. 11 | Ex. 12 | Ex. 13 |
|---|---|---|---|---|---|---|---|---|---|
| Foreign Matter Separating Unit | Vin | m/s | 25.0 | 25.0 | 25.0 | 25.0 | 25.0 | 25.0 | 25.0 |
| | Vout | m/s | 2.5 | 2.5 | 2.5 | 2.5 | 2.5 | 2.5 | 2.5 |
| | Angle θ Defined by Perpendicular Direction to Gravitational Direction | Degree (°) | 0 | 1 | 10 | 20 | 30 | 40 | 50 |
| | Blocking Portion Area Ratio | % | 25 | 25 | 25 | 25 | 25 | 25 | 25 |
| Foreign Matter Separating Rate | | % | 90 | 98 | 100 | 100 | 100 | 99 | 99 |
| Electric Charge of Toner | | μC/g | 25.6 | 25.1 | 25.7 | 25.9 | 25.4 | 25.5 | 25.7 |
| Damage on Photoreceptor | | | A | A | A | A | A | A | A |

TABLE 1-4

| | | | Ex. 14 | Ex. 15 | Ex. 16 | Ex. 17 | Ex. 18 | Ex. 19 | Ex. 20 | Ex. 21 |
|---|---|---|---|---|---|---|---|---|---|---|
| Foreign Matter Separating Unit | Vin | m/s | 25.0 | 25.0 | 25.0 | 25.0 | 25.0 | 25.0 | 25.0 | 25.0 |
| | Vout | m/s | 2.5 | 2.5 | 2.5 | 2.5 | 2.5 | 2.5 | 2.5 | 2.5 |
| | Angle θ Defined by Perpendicular Direction to Gravitational Direction | Degree (°) | 6 | 6 | 6 | 6 | 6 | 6 | 6 | 6 |
| | Blocking Portion Area Ratio | % | 0 | 5 | 10 | 20 | 30 | 40 | 50 | 60 |
| Foreign Matter Separating Rate | | % | 80 | 98 | 98 | 100 | 100 | 99 | 99 | 98 |
| Electric Charge of Toner | | μC/g | 25.1 | 25.9 | 25.4 | 25.3 | 25.3 | 25.4 | 25.7 | 25.1 |
| Damage on Photoreceptor | | | A | A | A | A | A | A | A | A |

In Table 1-3, and Table 1-4, "Angle θ Defined by Perpendicular Direction to Gravitational Direction" denotes "the angle formed between the perpendicular direction to the gravitational direction and the pipe center line that connects the center of the one end of the feeding pipe located at the connected portion between the feeding pipe and the foreign matter separating chamber, and the center of the other end opposite to this one end of the feeding pipe". "Blocking Portion Area Ratio" denotes the area of the blocking portion (%) relative to the area of the feeding pipe in the cross section in the perpendicular direction to the conveyance direction of the raw powder material of toner.

In Comparative Examples 1 to 6 having no foreign matter separating unit during the production of the toner, it was confirmed that damage was generated on each photoreceptor, which is considered to be caused because of contamination of the metallic foreign matters in the toner.

In Comparative Examples 1 to 6, damage and stop were caused to the mill.

To the contrary, in Examples 1 to 21, it was confirmed that no damage due to the metallic foreign matters was generated on each photoreceptor.

The angle formed between the perpendicular direction to the gravitational direction, and the pipe center line that connects the center of the one end of the feeding pipe located at the connected portion between the feeding pipe and the foreign matter separating chamber, and the center of the other end opposite to this one end of the feeding pipe was more than 0°, and 50° or less, so that the foreign matter separating rate became 98% or more, resulting in excellent performance (Examples 1, 8 to 13, for example). In addition, the above angle was 3° to 30°, so that the foreign matter separating rate became 100% (Examples 1, 9 to 11, for example).

The area of the blocking portion (blocking portion area ratio) relative to the area of the feeding pipe in the cross section in the perpendicular direction to the conveyance direction of the raw powder material of toner was more than 0%, and 60% or less, so that the foreign matter separating rate became 98% or more, resulting in excellent performance (Examples 1, 14 to 21, for example). In addition, the blocking portion area ratio was 20% to 30%, so that the foreign matter separating rate became 100% (Examples 1, 17 to 18, for example).

In Examples 1 to 21, no damage and no stop were caused to the mill.

No damage was caused to the photoreceptor even at the foreign matter separating rate of 80%. It can be considered that unseparated metallic foreign matters had no enough quantity and energy for causing damage to the photoreceptor at the foreign matter separating rate of 80%.

Aspects of the present invention are as follows, for example.

<1> A toner producing apparatus including:

a foreign matter separating unit including a foreign matter separating chamber for separating metallic foreign matters contained in raw powder material of toner from the raw powder material of toner by using gravity, a feeding pipe connected to the foreign matter separating chamber so as to feed the raw powder material of toner into the foreign matter separating chamber, and an exhausting pipe connected to the foreign matter separating chamber so as to exhaust the raw powder material of toner from the foreign matter separating chamber; and a pulverizing unit including a rotor, the pulverizing unit being connected to the exhausting pipe of the foreign matter separating unit.

<2> The toner producing apparatus according to <1>, wherein in the foreign matter separating chamber, a connected portion between the exhausting pipe and the foreign matter separating chamber is disposed at a gravitationally higher position than a connected portion between the feeding pipe and the foreign matter separating chamber.

<3> The toner producing apparatus according to <1> or <2>, wherein a center of one end of the feeding pipe located at the connected portion between the feeding pipe and the foreign matter separating chamber is disposed at a gravitationally lower position than a center of the other end opposite to the one end of the feeding pipe.

<4> The toner producing apparatus according to <3>, wherein an angle formed between a perpendicular direction to the gravitational direction and a pipe center line that connects the center of the one end of the feeding pipe located at the connected portion between the feeding pipe and the foreign matter separating chamber, and the center of the other end opposite to the one end of the feeding pipe is more than 0°, and 50° or less.

<5> The toner producing apparatus according to any one of <1> to <4>, wherein the feeding pipe includes a blocking portion disposed on an inner surface of the feeding pipe on an opposite side to the gravitational direction, and the blocking portion partially reduces an area of a cross section of the feeding pipe in a perpendicular direction to a conveyance direction of the raw powder material of toner.

<6> The toner producing apparatus according to <5>, wherein the blocking portion reduces the area of the cross section of the feeding pipe in the perpendicular direction to the conveyance direction of the raw powder material of toner by 20% to 30%.

<7> The toner producing apparatus according to any one of <1> to <6>, wherein the exhausting pipe is connected to a surface of the foreign matter separating chamber on the opposite side to the gravitational direction.

<8> The toner producing apparatus according to any one of <1> to <7>, wherein the foreign matter separating chamber includes a projection projecting inward of the foreign matter separating chamber at a connected portion between the exhausting pipe and the foreign matter separating chamber.

<9> The toner producing apparatus according to any one of <1> to <8>, wherein the pulverizing unit includes a rotor, and a stator disposed outward of an outer peripheral surface of the rotor with a gap between the stator and the rotor.

<10> The toner producing apparatus according to any one of <1> to <9>, wherein in the foreign matter separating chamber, the connected portion between the exhausting pipe and the foreign matter separating chamber is disposed at a gravitationally higher position than the connected portion between the feeding pipe and the foreign matter separating chamber, and a distance (L) between the connected portion between the exhausting pipe and the foreign matter separating chamber, and the connected portion between the feeding pipe and the foreign matter separating chamber satisfies the following Formula (1):

$$m \times g \times L_h > (1/2) \times m \times v^2 \qquad \text{Formula (1)}$$

where in the above Formula (1), $L_h$ denotes a component [m] in the gravitational direction of the distance (L), m denotes mass [g] of the metallic foreign matters, g denotes acceleration of gravity [m/s$^2$], and v denotes speed of the metallic foreign matters [m/s] at the connected portion between the feeding pipe and the foreign matter separating chamber.

<11> A toner producing method including;

separating metallic foreign matters contained in raw powder material of toner from the raw powder material of toner by using gravity; and pulverizing the raw powder material of toner exhausted in the separating the metallic foreign matters, wherein the separating the metallic foreign matters is carried out in a foreign matter separating chamber of a foreign matter separating unit that includes the foreign matter separating chamber for separating the metallic foreign matters contained in the raw powder material of toner from the raw powder material of toner by using gravity, a feeding pipe connected to the foreign matter separating chamber so as to feed the raw powder material of toner into the foreign matter separating chamber, and an exhausting pipe connected to the foreign matter separating chamber so as to exhaust the raw powder material of toner from the foreign matter separating chamber, and the pulverizing the raw powder material of toner is carried out by pulverizing the raw powder material of toner exhausted from the exhausting pipe in the separating the metallic foreign matters by using a pulverizing unit including a rotor.

<12> The toner producing method according to <11>, wherein in the foreign matter separating chamber, a connected portion between the exhausting pipe and the foreign matter separating chamber is disposed at a gravitationally higher position than a connected portion between the feeding pipe and the foreign matter separating chamber.

<13> The toner producing method according to <11> or <12>, wherein a center of one end of the feeding pipe located at the connected portion between the feeding pipe and the foreign matter separating chamber is disposed at a gravitationally lower position than a center of the other end opposite to the one end of the feeding pipe.

<14> The toner producing method according to <13>, wherein an angle formed between a perpendicular direction to the gravitational direction and a pipe center line that connects the center of the one end of the feeding pipe located at the connected portion between the feeding pipe and the foreign matter separating chamber, and the center of the other end opposite to the one end of the feeding pipe is more than 0°, and 50° or less.

<15> The toner producing method according to any one of <11> to <14>, wherein the feeding pipe includes a blocking portion disposed on an inner surface of the feeding pipe on an opposite side to the gravitational direction, and the blocking portion partially reduces an area of a cross section of the feeding pipe in a perpendicular direction to a conveyance direction of the raw powder material of toner.

<16> The toner producing method according to <15>, wherein the blocking portion reduces the area of the cross section of the feeding pipe in the perpendicular direction to the conveyance direction of the raw powder material of toner by 20% to 30%.

<17> The toner producing method according to any one of <11> to <16>, wherein the exhausting pipe is connected to a surface of the foreign matter separating chamber on the opposite side to the gravitational direction.

<18> The toner producing method according to any one of <11> to <17>, wherein the foreign matter separating chamber includes a projection projecting inward of the foreign matter separating chamber at a connected portion between the exhausting pipe and the foreign matter separating chamber.

<19> The toner producing method according to any one of <11> to <18>, wherein the pulverizing unit includes a rotor, and a stator disposed outward of an outer peripheral surface of the rotor with a gap between the stator and the rotor.

<20> The toner producing method according to any one of <11> to <19>, wherein in the foreign matter separating chamber, the connected portion between the exhausting pipe and the foreign matter separating chamber is disposed at a gravitationally higher position than the connected portion between the feeding pipe and the foreign matter separating chamber, and a distance (L) between the connected portion between the exhausting pipe and the foreign matter separating chamber, and the connected portion between the feeding pipe and the foreign matter separating chamber satisfies the following Formula (1):

$$m \times g \times L_h > (1/2) \times m \times v^2 \quad \text{Formula (1)}$$

where in the above Formula (1), $L_h$ denotes a component [m] in the gravitational direction of the distance (L), m denotes mass [g] of the metallic foreign matters, g denotes acceleration of gravity [m/s$^2$], and v denotes speed of the metallic foreign matters [m/s] at the connected portion between the feeding pipe and the foreign matter separating chamber.

This application claims priority to Japanese application No. 2012-197461, filed on Sep. 7, 2012 and incorporated herein by reference.

What is claimed is:

1. A toner producing apparatus, comprising:

a foreign matter separating unit including:

a foreign matter separating chamber for separating metallic foreign matter contained in raw powder material of toner from the raw powder material of toner, a feeding pipe connected to the foreign matter separating chamber so as to feed the raw powder material of toner into the foreign matter separating chamber, and an exhausting pipe connected to the foreign matter separating chamber so as to exhaust the raw powder material of toner from the foreign matter separating chamber, wherein one end of the feeding pipe connects to the foreign matter separating chamber at a first connected portion between the feeding pipe and the foreign matter separating chamber, and a center of the one end of the feeding pipe is disposed at a gravitationally lower position than a center of an opposite end of the feeding pipe; and a pulverizing unit including a rotor, the pulverizing unit being connected to the exhausting pipe of the foreign matter separating unit.

2. The toner producing apparatus according to claim 1, wherein in the foreign matter separating chamber, one end of the exhausting pipe connects to the foreign matter separating chamber at a second connected portion between the exhausting pipe and the foreign matter separating chamber, and the second connected portion is disposed at a gravitationally higher position than the first connected portion between the feeding pipe and the foreign matter separating chamber.

3. The toner producing apparatus according to claim 1, wherein an angle formed between a perpendicular direction to a gravitational direction and a pipe center line that connects the center of the one end of the feeding pipe and the center of the opposite end of the feeding pipe is more than 0°, and 50° or less.

4. The toner producing apparatus according to claim 1, wherein the feeding pipe includes a blocking portion disposed on an inner surface of the feeding pipe on an opposite side to a gravitational direction, and the blocking portion partially reduces an area of a cross section of the feeding pipe in a perpendicular direction to a conveyance direction of conveying the raw powder material of toner via the feeding pipe.

5. The toner producing apparatus according to claim 4, wherein the blocking portion reduces the area of the cross section of the feeding pipe in the perpendicular direction to the conveyance direction of the raw powder material of toner by 20% to 30%.

6. The toner producing apparatus according to claim 4, wherein the blocking portion sequentially blocks the inner surface of the feeding pipe toward the gravitational direction from the opposite direction to the gravitational direction of the inner surface of the feeding pipe.

7. The toner producing apparatus according to claim 1, wherein the exhausting pipe is connected to a surface of the foreign matter separating chamber on an opposite side to a gravitational direction.

8. The toner producing apparatus according to claim 1, wherein one end of the exhausting pipe connects to the foreign matter separating chamber at a second connected portion between the exhausting pipe and the foreign matter separating chamber, and the foreign matter separating chamber includes a projection projecting inward of the foreign matter separating chamber at the second connected portion.

9. The toner producing apparatus according to claim 1, wherein the pulverizing unit includes a rotor, and a stator disposed outward of an outer peripheral surface of the rotor with a gap between the stator and the rotor.

10. The toner producing apparatus according to claim 1, wherein in the foreign matter separating chamber, one end of the exhausting pipe connects to the foreign matter separating chamber at a second connected portion between the exhausting pipe and the foreign matter separating chamber, the second connected portion is disposed at a gravitationally higher position than the first connected portion between the feeding pipe and the foreign matter separating chamber, and a distance (L) between the second connected portion between the exhausting pipe and the foreign matter separating chamber, and the first connected portion between the feeding pipe and the foreign matter separating chamber satisfies the following Formula (1):

$$m \times g \times L_h > (1/2) \times m \times v^2 \quad \text{Formula (1)}$$

where in the above Formula (1), $L_h$ denotes a component (m) in the gravitational direction of the distance (L), m denotes mass (g) of the metallic foreign matter, g denotes acceleration of gravity ($m/s^2$), and v denotes speed of the metallic foreign matter (m/s) at the connected portion between the feeding pipe and the foreign matter separating chamber.

11. A toner producing apparatus, comprising:

a foreign matter separating unit including:

a foreign matter separating chamber for separating metallic foreign matter contained in raw powder material of toner from the raw powder material of toner, a feeding pipe connected to the foreign matter separating chamber so as to feed the raw powder material of toner into the foreign matter separating chamber, and an exhausting pipe connected to the foreign matter separating chamber so as to exhaust the raw powder material of toner from the foreign matter separating chamber, wherein one end of the feeding pipe connects to the foreign matter separating chamber at a first connected portion between the feeding pipe and the foreign matter separating chamber, one end of the exhausting pipe connects to the foreign matter separating chamber at a second connected portion between the exhausting pipe and the foreign matter separating chamber, and the second connected portion is disposed at a gravitationally higher position than the first connected portion between the feeding pipe and the foreign matter separating chamber; and a pulverizing unit including a rotor, the pulverizing unit being connected to the exhausting pipe of the foreign matter separating unit.

12. The toner producing apparatus according to claim 11, wherein an angle formed between a perpendicular direction to a gravitational direction and a pipe center line that connects the center of the one end of the feeding pipe and the center of the opposite end of the feeding pipe is more than 0°, and 50° or less.

13. The toner producing apparatus according to claim 11, wherein the feeding pipe includes a blocking portion disposed on an inner surface of the feeding pipe on an opposite side to a gravitational direction, and the blocking portion partially reduces an area of a cross section of the feeding pipe in a perpendicular direction to a conveyance direction of conveying the raw powder material of toner via the feeding pipe.

14. The toner producing apparatus according to claim 13, wherein the blocking portion reduces the area of the cross section of the feeding pipe in the perpendicular direction to the conveyance direction of the raw powder material of toner by 20% to 30%.

15. The toner producing apparatus according to claim 13, wherein the blocking portion sequentially blocks the inner surface of the feeding pipe toward the gravitational direction from the opposite direction to the gravitational direction of the inner surface of the feeding pipe.

16. The toner producing apparatus according to claim 11, wherein the exhausting pipe is connected to a surface of the foreign matter separating chamber on an opposite side to a gravitational direction.

17. The toner producing apparatus according to claim 11, wherein the foreign matter separating chamber includes a projection projecting inward of the foreign matter separating chamber at the second connected portion.

18. The toner producing apparatus according to claim 11, wherein the pulverizing unit includes a rotor, and a stator disposed outward of an outer peripheral surface of the rotor with a gap between the stator and the rotor.

19. The toner producing apparatus according to claim 11, wherein in the foreign matter separating chamber, a distance (L) between the second connected portion between the exhausting pipe and the foreign matter separating chamber, and the first connected portion between the feeding pipe and the foreign matter separating chamber satisfies the following Formula (1):

$$m \times g \times L_h > (1/2) \times m \times v^2 \quad \text{Formula (1)}$$

where in the above Formula (1), $L_h$ denotes a component (m) in the gravitational direction of the distance (L), m denotes mass (g) of the metallic foreign matter, g denotes acceleration of gravity ($m/s^2$), and v denotes speed of the metallic foreign matter (m/s) at the connected portion between the feeding pipe and the foreign matter separating chamber.

* * * * *